US005315776A

United States Patent [19]

Strawbridge et al.

[11] Patent Number: 5,315,776

[45] Date of Patent: May 31, 1994

[54] MULTIPLE-DISPLAY SIGN DEVICE

[75] Inventors: Jon P. Strawbridge, Glendale; Mark A. Fredricks, Elm Grove, both of Wis.

[73] Assignee: Everbrite, Inc., Greenfield, Wis.

[21] Appl. No.: 957,719

[22] Filed: Oct. 7, 1992

[51] Int. Cl.[5] ..... G09F 11/02

[52] U.S. Cl. ..... 40/505; 40/502; 362/35

[58] Field of Search ..... 40/480, 502, 503, 504, 40/505, 506; 362/35, 812

[56] References Cited

U.S. PATENT DOCUMENTS

| | | | |
|---|---|---|---|
| 566,087 | 8/1896 | McCormack . | |
| 1,466,766 | 9/1923 | White . | |
| 1,797,773 | 3/1931 | Hoban . | |
| 2,680,316 | 6/1954 | Webster et al. | 40/505 X |
| 3,199,239 | 8/1965 | Reed . | |
| 3,273,271 | 9/1966 | Werner | 40/502 |
| 3,383,785 | 5/1968 | Werner | 40/480 X |
| 3,919,794 | 11/1975 | Hunter, Jr. | 40/502 X |
| 4,002,022 | 1/1977 | Lopez C. | 40/505 X |
| 4,381,616 | 5/1983 | Saxer . | |
| 4,418,378 | 11/1983 | Johnson | 362/97 |
| 4,528,763 | 7/1985 | Ahlgren . | |
| 4,771,558 | 9/1988 | Roberts et al. | 40/505 |
| 5,003,716 | 4/1991 | Dyar . | |

*Primary Examiner*—Brian K. Green

*Attorney, Agent, or Firm*—Ryan, Kees & Hohenfeldt

[57] ABSTRACT

A sign in which multiple scenes are presented in sequence is comprised of a plurality of juxtaposed rotationally driven display units that are assembled with triangularly-shaped hollow sleeves whose side panels are constituted by transparencies on each of which there is a portion of a different complete scene. There are adapters on the upper and lower ends of the display units which have bushings for allowing the juxtaposed display units to be journaled for rotation on a stationary light transmissive tubes that serves as axles. The tubes are retained at their lower ends in a row of equally spaced apart and colinear bores and they are retained at their upper ends by a plate which also has a corresponding row of bores that provide for stabilizing the upper ends of the tubes and for maintaining them in perfect alignment and spacing. The units are driven rotationally in synchronism by means of an electric motor that provides the power input to mechanical elements which interlock all of the display units mechanically to assure that they rotate in and remain in synchronism such that when corresponding panels of the display units, which panels each represent a portion of a scene, are rotated into coplanar and stationary position the scene is formed for visualization.

11 Claims, 5 Drawing Sheets

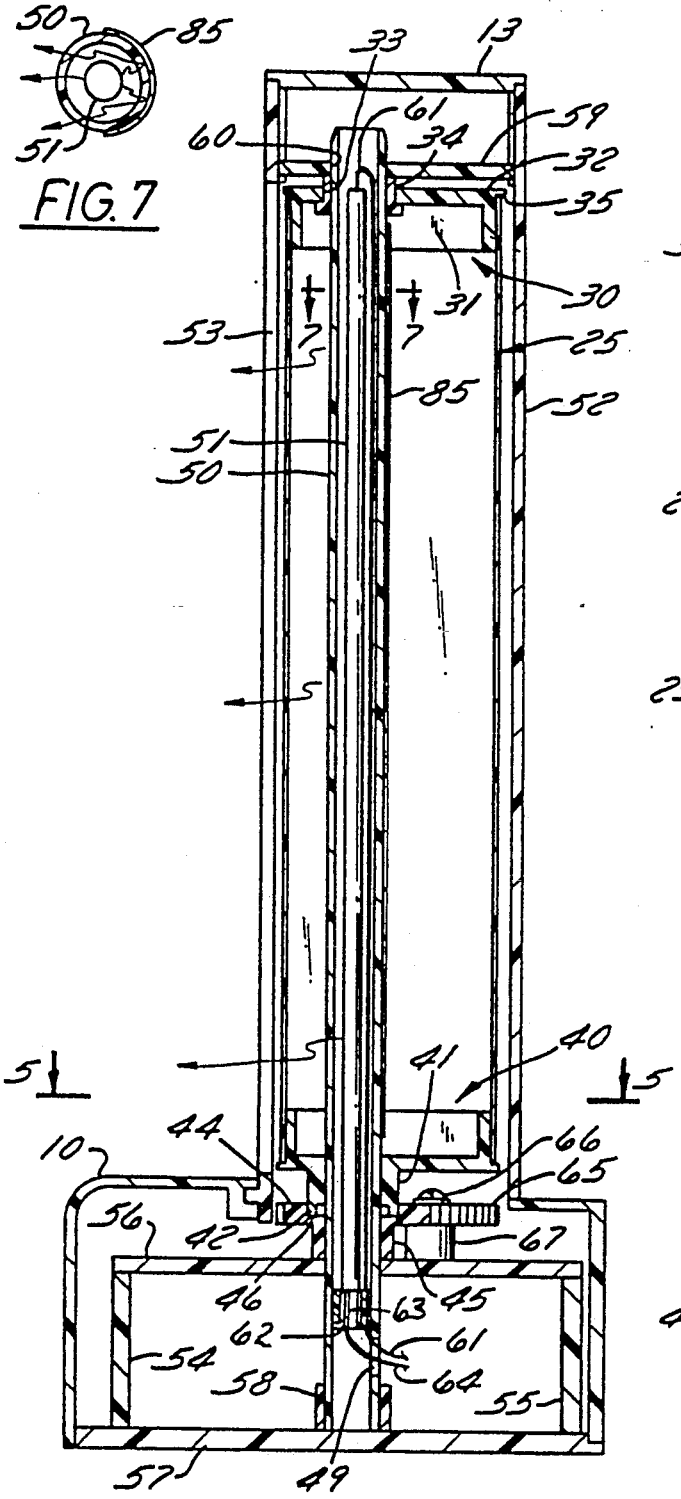
FIG. 7
FIG. 4
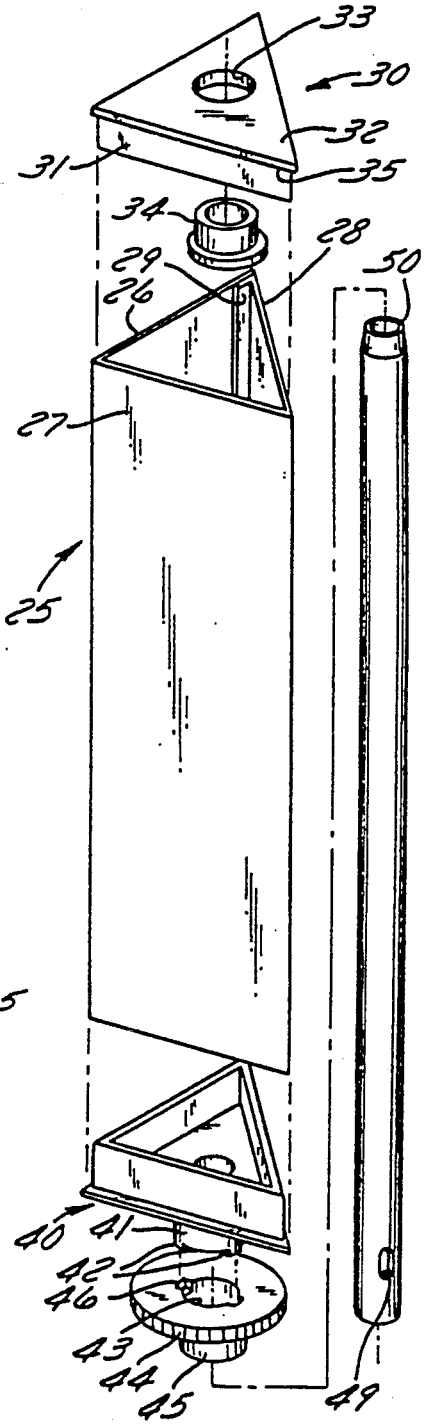
FIG. 3

MULTIPLE-DISPLAY SIGN DEVICE

BACKGROUND OF THE INVENTION

The invention disclosed herein relates to a sign and particularly to an automatically changeable sign in which a plurality of information bearing panels rotate intermittently in unison to compose different scenes that may be pictorial, artistic or informational.

Illuminated displays or signs which exhibit pictorial information, graphics, written descriptions and the like wherein when several sets of panels each containing a portion of a different scene are rotated to a coplanar position, an intelligible scene is composed for being visualized. Signs having these general characteristics have been proposed wherein portions of any of the scenes appear on corresponding sides of elongated triangular assemblies which rotate in unison on a vertical axis and stop in coplanar position A sign of this general type is shown in U.S. Pat. No. 4,381,616. This patent discloses display units in which portions of a scene are formed on a plurality of rotatable triangularly arranged transparency panels, each of which units contains an elongated centrally located light source to provide for visualizing the scene. The patent does not disclose all of the structural details for making an operative sign but it does reveal some of the problems which the sign disclosed herein has solved. One problem to be solved is that of avoiding leakage of light along the lines where the edges of the panels of the display units meet when members of a single scene arrive in coplanar position. This problem can be avoided by constructing the sign in such a way that tolerances can be kept very low as in the case of the present invention so the joints between adjacent panels of the display units are hardly visible. The solution proposed in the cited patent is one that attempts to compensate for rather than eliminate light leakage gaps between the edges of the panels by closing the gaps with flaps that overlay each other and are mounted to the edges of the individual triangular display units. Such gaps may not be too distracting if only alpha numeric information or scenes are being presented in sequence but they spoil the aesthetic quality of artistic pictorial scenes.

SUMMARY OF THE INVENTION

An object of the present invention is to provide a changeable scene sign which is designed and is assembled in such a manner that all of the parts are accurately secured in positions which result in joints between display panels being substantially obscured. A corollary to this objective is to provide a sign structure that can be quickly and easily assembled and disassembled to provide for changing scenes which the sign is to display and yet maintain precision in the relationship of the parts comprising each sign.

Briefly stated, the new sign or display device comprises a base. A group of equally spaced apart, parallel and vertical transparent tubes are inserted in a row of openings arranged along the base so as to hold the lower ends of the tubes in fixed position with their axes lying on the same imaginary plane. Upper ends of the tubes are secured in precise physical relationship with the lower end by the use of a plate which has a row of holes for allowing the plate to be slipped over the upper ends of the transparent tubes to hold the upper ends in precise position relative to each other in all directions. An elongated light emitting source is fixed inside of each tube. Information to be displayed is presented with display units that are comprised of upper and lower adapters that have side walls arranged in triangular form. Portions of each of the scenes that are to be displayed in sequence are deposited adjacent each other on a transparent plastic sheet by multicolor lithography, photography or silk screening, for example. These sheets are folded into hollow triangular form to coincide in shape with the triangularly arranged side walls of the adapters and the adapters are fitted into the ends of the forms and these assemblies become display units having three transparency side panels. The adapters have bushings located centrally in them so that the display units, comprised of the three triangularly arranged panels with upper and lower adapters, can be slid onto the light transparent tube for rotation thereon. The lower adapter for each of the display units is engaged with a rotation driving means such as a gear that is journaled for rotation on the lower end of the stationary transparent light transmitting tube. All of the display units are mechanically interconnected so that when a drive motor rotates them they remain in synchronism and all of the panels that compose one of three scenes in the illustrative embodiment are driven to a perfectly coplanar condition for presentation of a scene without unpleasantly perceptible joints between them.

In the embodiment of the invention just outlined the triangular display units rotate on transparent tubes acting as stationary axes and an elongated light source such as a fluorescent tube resides inside of the transparent tubes. In an alternative embodiment the transparent tube is eliminated and the display units are journaled directly on the light source for rotation.

How the foregoing objectives and other objectives of the invention are achieved will be evident in the ensuing description of a preferred embodiment of the invention which will now be set forth in reference to the drawings.

DESCRIPTION OF THE DRAWINGS

FIG. 3 is an exploded perspective view of one of the display units;

FIG. 4 is a vertical section taken through one of the display units in an assembled sign;

FIG. 7 is a transverse section taken on a plane corresponding 7—7 in FIG. 4;

DESCRIPTION OF A PREFERRED EMBODIMENT

As indicated earlier, the new sign device has the capability of displaying various kinds of information such as pictorials, menus, graphics, price information and other information. For the sake of brevity, and for the sake of selecting a word that is generic to the various kinds of information that can be displayed with this sign, such information will be referred to herein as a "scene".

Figure 1:
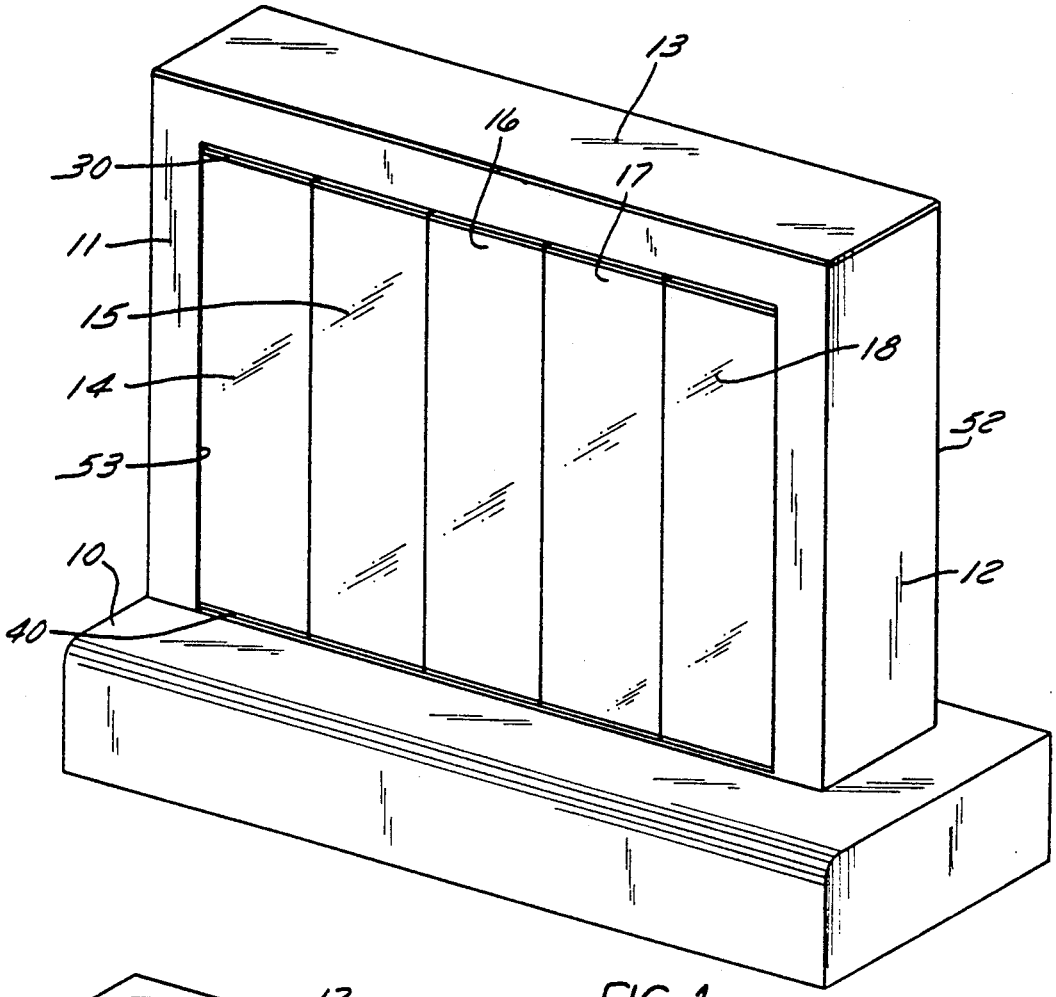
FIG. 1 is a perspective view of an illustrative embodiment of the invention.

Attention is invited to FIG. 1 which shows a perspective view of an illustrative embodiment of the sign which comprises a housing including a base 10 and side and top members 11, 12 and 13. At the present time, corresponding panels 14–18 of the respective units are in coplanar condition to compose a scene and are presented toward the viewer. Panels 14–18 each contain a portion of a scene which is composed when the panels reach coplanar position as they have done in FIG. 1.

Figure 2:
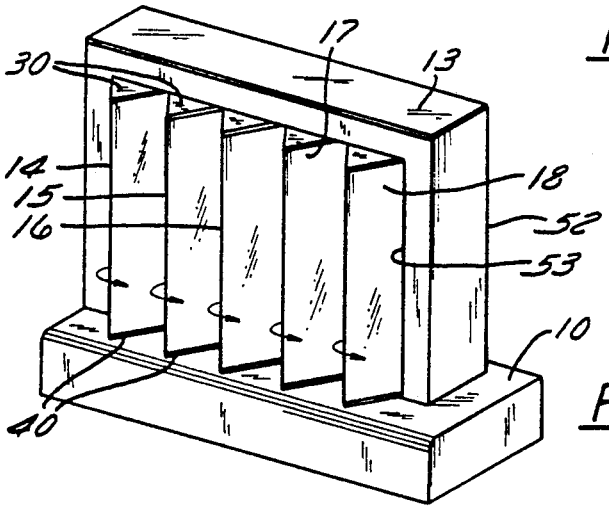
FIG. 2 similar to FIG. 1 except that it shows the triangular display units in the process of rotating for panels that form part of the same scene to become coplanar and stop to permit viewing the scene.

FIG. 2 is similar to FIG. 1 except the triangular display units are rotating to present another scene in the sequence of scenes to viewers.

Attention is now invited to FIG. 3 which shows an exploded view of one of the display units. The unit comprises a sheet having the properties of a transparency which is folded into the form of a hollow prism, particularly into a triangular configuration, and is generally designated by the reference numeral 25. Before the sheet is folded and formed into a hollow triangular element the three side panels 26, 27 and 28 have a portion of a different scene displayed on them in juxtaposition. In an actual embodiment, each of the panels is similar to a transparency upon which the portions of the individual scenes are printed by silk screening, for example. The total width of the unfolded sheet is such that a small flap 29 remains to underlay one of the panels, such as panel 26, after the sheet is folded to provide for gluing the flap to the back of panel 26 to form the triangular display member 25 into a sleeve. The upper adapter 30 shown in FIG. 3 has three triangularly arranged side walls such as the one marked 31. The adapter has a top wall 32 in which there is a hole 33. The hole 33 in the adapter is for accepting the cylindrical body of a shouldered bushing 34. Adapter 30 and the bushing 34 could be molded as a single plastic piece. The adapter 30 walls are preferably transparent and flat areas such as area 32 should be opaque to prevent light from radiating in directions in which it should not radiate It should be noted that the adapter 30 has a rim 35 which establishes the distance in which the adapter can be inserted in the open top end of the triangular display unit sleeve 25.

An adapter 40 is also provided for the lower end of the triangular display unit 25. Adapter 40 is similar in construction to adapter 30. Adapter 40 has a hub 41 extending from its bottom side and there are diametrically opposite axially extending lugs 42, similar to straight keys, molded integrally with the cylindrical outside of hub 41. The cylindrical portion of the bushing fits into the bore 43 of the display unit driving member which, in this embodiment, is a gear 44. The gear has a hub 45 that is provided with diametrically opposite axially extending slots or keyways 46 to which the keys or lugs 42 on hub 41 register to put the gear in driving relationship with the display unit 25.

In FIG. 3, a stationary transparent plastic tube 50 is also shown. The outside diameter of the tube 50 is approximately equal to the inside diameter of the adapter bushing 34 and hub 41 so a display unit 25 can be slipped onto the tube 50 with the display unit to be journaled for rotation on tube 50. The tube 50 has a radial hole 49 that is provided for accommodating electric lead wires to supply an elongated light source or lamp 51 which will be discussed further in connection with FIG. 4 to which attention is now invited.

In FIG. 4 it will be evident that the sign or display device housing has a closed back wall 52 and an open front window 53. Inside of the housing base portion 10 there is a chamber which runs the length of the sign and is defined by side walls 54 and 55 and top and bottom walls, respectively, 56 and 57. The walls of the chamber may be joined by screws or adhesive as desired. The lowermost end of light transmitting tube 50 is press fit into the bore of a cylindrical element or socket that is designated by the numeral 58 and is secured to the bottom plate 57 of the housing. The socket stabilizes the lower end of tube 50 in all directions. The upper end of tube 50 is stabilized by a plate 59 that has a row of holes such as the one marked 60 in FIG. 4. The center-to-center distance of these holes along the length of plate 59 is the same as the center-to-center distance of the row of cylindrical members 58 which holds the lower ends of the tubes 50 for each of the display units 25. Plate 59 is precisely positioned such that its holes 60 for receiving the upper ends of light transmitting tube 50 are exactly vertical to the axis of the cylindrical sockets 58 which hold the lower ends of the tubes. Thus, there is no special instrument nor skill needed for assembling the display units 25 accurately since when the transparent tubes are pressed into the sockets, setting the top plate 59 on them automatically aligns all parts. In FIG. 4 the elongated light source 51 is installed in the bore of light transmitting tube 50. A suitable type of light source 51 is a cold cathode fluorescent tube. In this model, the upper terminal of light source 51 has a lead wire 61 connected to it. This lead wire runs down the side of light source 51 within the bore of light transmitting tube 50 and exits from the tube through the hole 49 in the side of the tube 50. The terminal 62 at the lower end of light source 51 registers in a conductive contact 63 from which another lead 64 extends through hole 49 and runs to an electric source, not shown. The light source 51 is energized when the display device or sign is operated so that scenes created by the composition of scene portions represented by corresponding panels in the sides of the display units 25 are visible and intelligible when the panels are coplanar. A strip of light reflective material 85 is fastened to the periphery of each light transmissive tube 50, said strip extending axially of the tube 50 substantially co-extensive with the elongated tubular light source 51 as shown in FIG. 4, for example.

FIG. 4 illustrates how the triangular display units 25 are able to rotate on stationary light transmitting tubes 50 on the upper and lower bushings 34 and 41 of the respective upper and lower adapters 30 and 40. As explained earlier in connection with discussing FIG. 3, hub 41 of the lower adapter 40 is releasably engaged by means of lugs 42 with the gear 44 which is provided for each one of the display units. Hub 45 of gear 44 bears on the top plate 56 of the chamber which serves as a thrust bearing.

Figure 8:
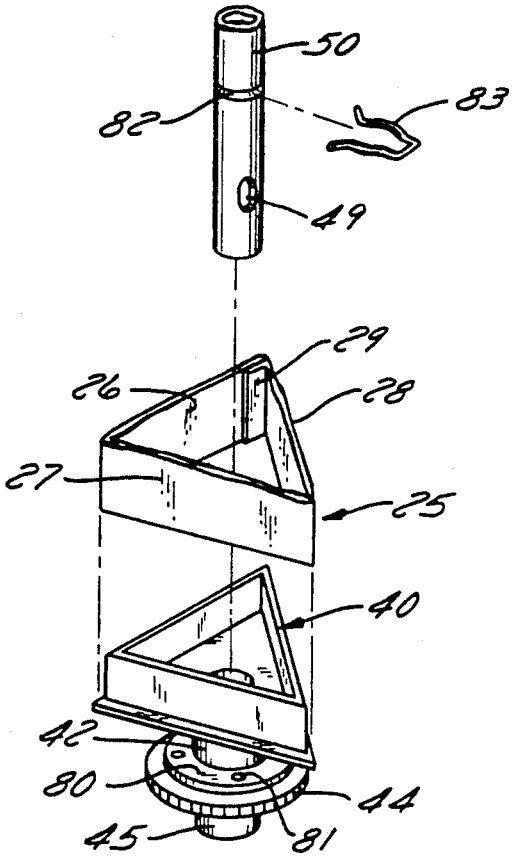
FIG. 8 is a fragmentary exploded perspective view of a modified form of a display unit.
Figure 9:
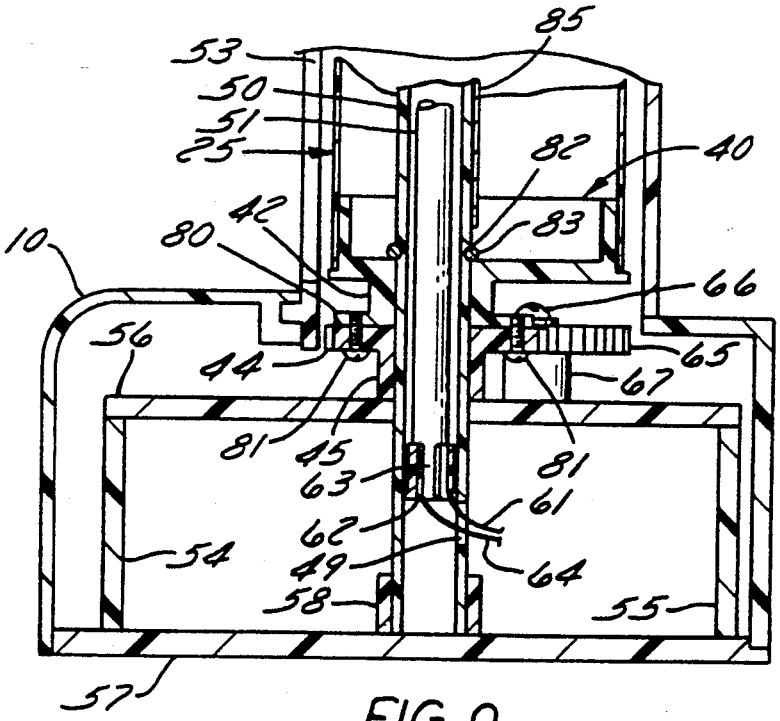
FIG. 9 is a fragmentary partial vertical section of a display unit having the features that are present in the FIG. 8 modification.

FIGS. 8 and 9 show a modification of the invention. In the previously described embodiment, such as in FIG. 3, when one display unit is to be substituted for another, the display unit 25 and the upper and lower triangular adapters 30 and 40 were removed as a unit. This was possible because the lower triangular adapter 40 has a key 42 on its collar and there is a keyway 43 in the gear which drives the unit. This permitted withdrawing the entire unit from the driving gear 44. This convenient and rapid way of substituting triangular display units 25 is continued in a slightly modified form in the FIGS. 8 and 9 embodiment. In this embodiment, the lower triangular adapter 40 is fixedly coupled to the driving gear 44. This is accomplished by providing the hub 42 of adapter 40 with a flange 80 that permits fastening the gear to the triangular adapter 40 by means of screws such as the one marked 81 in FIGS. 8 and 9.

As shown in the figures, the lower adapter 40 is retained on light transmissive tube 50 by means of a spring clip 83 that registers in an annular groove 82 in the tube 50. Hence, in the FIGS. 8 and 9 embodiment, substitution of a display unit 25 involves grasping the upper triangular adapter and sliding the adapter off of tube 50 such that the triangular display unit 25 is carried with the adapter. It should be appreciated that all of the display units 25 making up a sign will be substituted at any given time to provide three new scenes for display In neither of the embodiments is it necessary to use any tools for substituting display units. It is only necessary to remove the plate 59 which stabilizes the upper ends of the light transmissive tubes 50 on which the display units rotate such that the display units can be slid off of the tubes one after another. When the substitution of new units 25 is completed, the plate 59 is fitted onto the tubes 50 again and all of the tubes are stabilized in a perfectly vertical and equally spaced apart condition.

Figure 5:
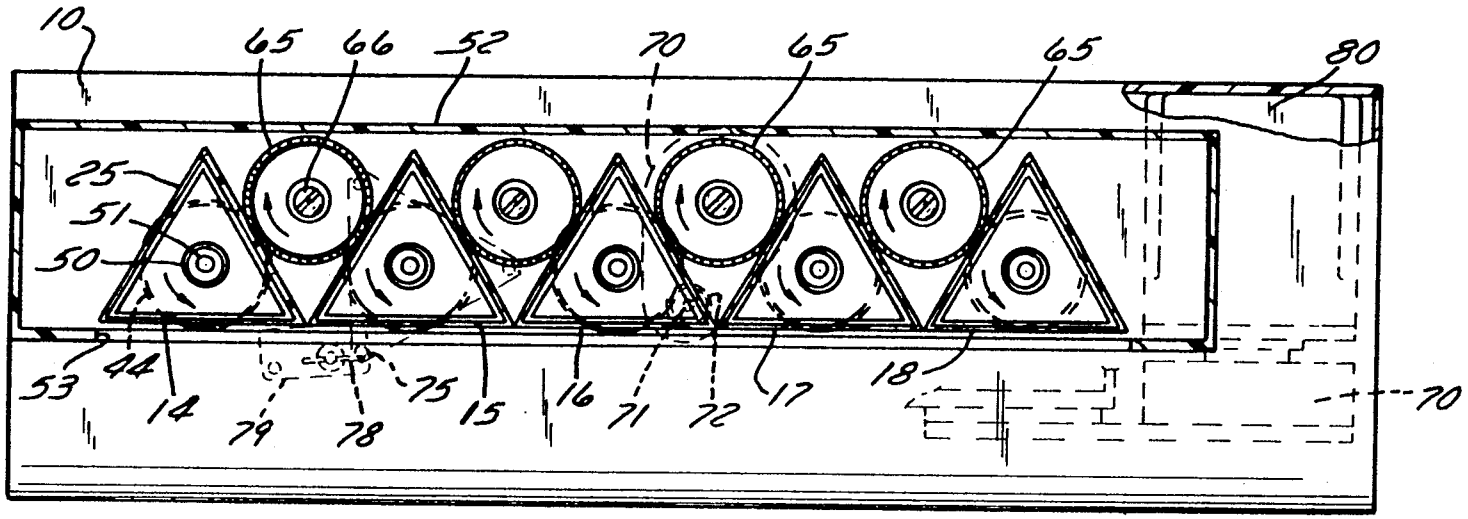
FIG. 5 is a horizontal section taken along the plane 5—5 in FIG. 4.

As previously mentioned, each light transmissive tube 50 for a display unit has gear 44 journaled for rotation on it and the gear is coupled to the lower adapter 40 for driving the display units rotationally. All of the units are driven in perfect synchronism in the illustrated embodiment by having all of the gears 44 interconnected by and meshed with intermediate gears such as the one marked 65 in FIGS. 4, 5 and 6. The gears 65 are free to rotate on stud shafts, such as the one marked 66 in FIG. 4, which are driven into fixed pads 67. The display unit driving mechanism in the illustrated embodiment is depicted in greater detail in FIG. 5. Here again, a gear for driving an individual triangular display unit 25 is marked 44 as it was in FIG. 4. There are intermediate gears such as the one marked 65 in the row of four gears in FIG. 5 that are meshed with the driven gears 44 on the individual display units 25 as shown in dashed lines in FIG. 5 and in solid lines in FIG. 6. There is a gear reduced motor 70, outlined in FIGS. 5 and 6, which has an output shaft 71 on which there is a pinion 72. Pinion 72 meshes with any one of the gears 44 that is journaled on the light transparent tubes 50 and since all of the gears 44 and intermediate gears 65 are intermeshed, the motor necessarily drives all of the display units 25 in synchronism as they are set in the same phase relationship during assembly of the sign.

It will be understood by skilled mechanics that display units 25 may be rotated intermittently in synchronism by means other than a gear train.

It is, of course, necessary to control operation of the drive motor 70 such that all panels of the respective display units pertaining to the same scene become coplanar and dwell there at least long enough for a viewer to appreciate the scene. Then, after a selected dwell time expires, the motor is started again to present another scene.

Figure 6:
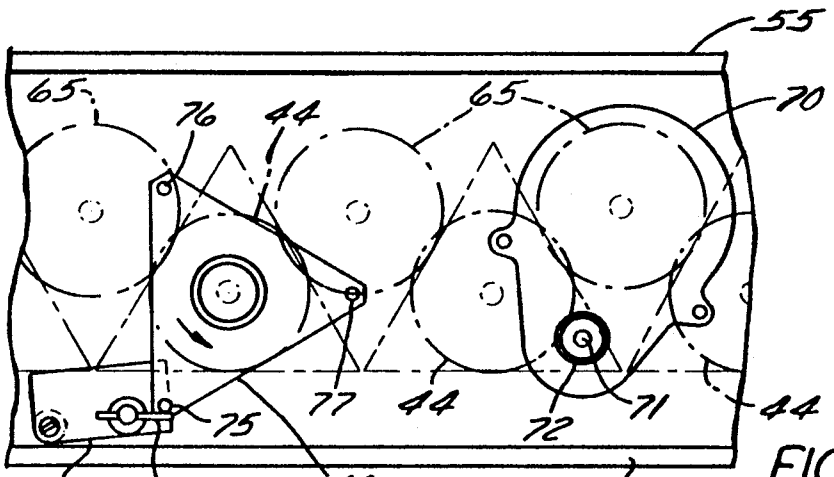
FIG. 6 is a fragmentary view showing how the motor which drives the triangular display units in unison is coupled to the units.

In the described embodiment, as shown in FIG. 6, scene presentation time is achieved by having one of the triangularly-shaped adapters 40 be provided at its corners or apices with vertically extending pins 75, 76 and 77. These pins swing in the path of a trigger arm 78 of a toggle switch 79. Energization of motor 70 and rotation of the display units 25 in unison is governed by a control device that is designated generally by the numeral 80 in FIG. 5. Although the circuitry is not shown, when limit switch trigger lever 78 is actuated, a signal is sent to controller 80 which causes it to deenergize motor 70 to hold the panels of the triangular display units in coplanar position as in FIG. 1 long enough to at least comprehend the content of the scene. One of the pins 75, 76 or 77 toggles the toggle switch 79 and the controller responds by stopping the motor as has been explained When the motor stops the controller begins measuring the dwell time and it restarts the motor at expiration of the dwell time. Those skilled in the art will appreciate that sensing when the panels are in coplanar position can be accomplished by the use of devices other than pins actuating a toggle switch. By way of example, photosensors, proximity sensors, magnetic sensors and/or magnetoresistive sensors could be used. Controllers 80 that utilize semiconductor circuit elements, not shown, for setting run and dwell times are known and need no further explanation since those skilled in the art of electric control circuits can devise a variety of ways of controlling the sign or one may simply select a commercially available sequence timer that is suitable for the purpose.

Attention is now invited to the alternative embodiment of the invention shown in FIGS. 10 and 11 wherein parts which are similar to those shown in the FIGS. 3 and 4 embodiment will be given the same reference numerals.

Figure 10:
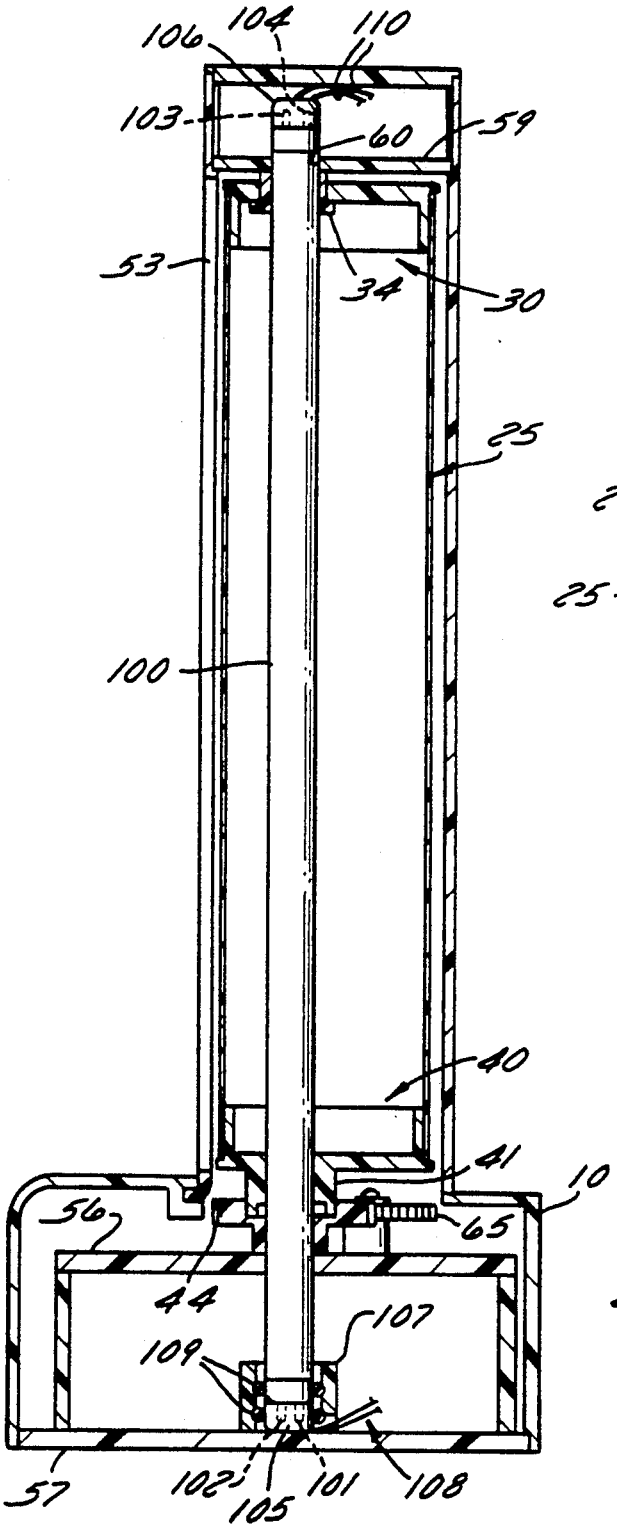
FIG. 10 is a vertical sectional view of an alternative embodiment of a display unit.
Figure 11:
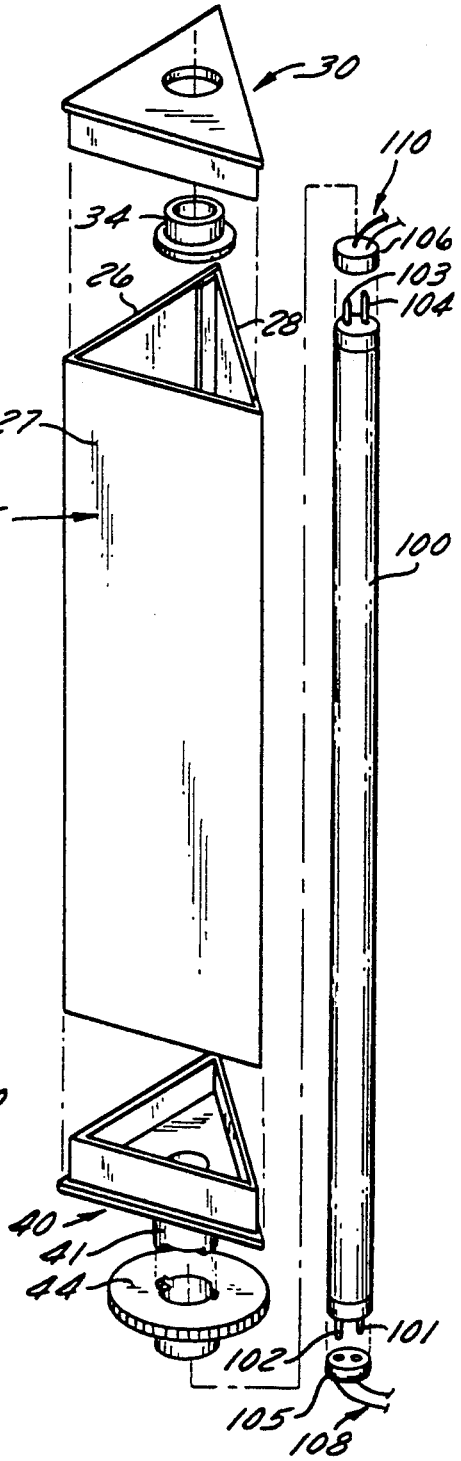
FIG. 11 is an exploded perspective view of the embodiment depicted in FIG. 10.

In FIGS. 10 and 11 a typical triangular display unit 25 having the transparency sides 26, 27 and 28 is journaled for rotation directly on an elongated light source such as a hot or cold cathode fluorescent tube 100. The lower end of tube 100 used as an example has two pins 101 and 102 extending from it and the upper end has two similar pins 103 and 104. The pairs of pins engage in electrical sockets 105 and 106, respectively.

As is evident in FIG. 10, lower electrical socket 105 is anchored in a cylinder 107. The socket has lead wires 108 extending from it. The two pins 101 and 102, by being engaged in socket 105, prevent the light emitting tube 100 from turning if there should be frictional drag on the tube due to the display unit 25 turning on the tube. O-rings such as the one marked 109 further stabilize the lower end of the tube and prevent it from turning, which is necessary when cold cathode tubes that have end contacts but no pins are used.

The upper end of tube 100 is stabilized in vertical condition and in line with tubes of other display units by means of plate 59 which has an aperture 60 through which the tube 100 passes with little clearance. Upper electrical socket 106 does not necessarily have to be anchored. This socket has electrical leads 110 extending from it.

As in the embodiment described earlier, the upper adapter 30 has a bushing and the lower adapter 40 has a bored hub 41 by which display unit 25 is journaled for rotation directly on fluorescent tube 100. Hub 41 couples to driven gear 44 and the latter meshes with driving gear 65.

Although embodiments of the invention have been described in such detail as to enable those skilled in the art to reproduce it, such description is intended to be illustrative rather than limiting, for the invention may be variously embodied and is to be limited only by interpretation of the claims which follow.

We claim:

1. A device for displaying a plurality of scenes in sequence, comprising:

a first horizontally disposed plate member having a row of equally spaced apart openings, and one end of a tube made out of a light transmitting material releasably inserted in each of the openings such that the tubes are correspondingly spaced apart, having parallel axes and all axes lie in the same vertical plane, an elongated light source in each said tube, display units for rotating on the respective tubes, each of the display units comprising three thin transparency panels constituting a triangular prism having opposite open ends, a pair of adapter elements each having three corresponding sides arranged in triangular configuration for fitting into said opposite open ends of the triangular prism, the adapter elements having an opening to provide for the display units to rotate on the respective tubes, each of the transparency panels in a display unit comprising a portion of one of three available scenes, means for maintaining said transparency panels that represent portions of the same scene in each said triangular prism in fixed rotational angular relationship such that when said panels of the triangular prisms representing portions of the same scene are rotated to contiguous coplanar relationship said scene is composed for visualization, a second horizontally disposed plate member having openings for fitting, respectively, onto the other ends of said tubes for stabilizing the tubes, and means for supporting the second plate member, an electric motor and means for coupling said motor to said display units for driving said display units rotationally in synchronism.

2. The device according to claim 1 including a bushing in each of said adapter elements positioned centrally in said triangular prisms, said bushings providing openings for the display units to rotate on the tubes.

3. The device according to claim 1 wherein the transparency panels have widths and opposite edges between which the widths of the respective panels extend and the widths of all transparency panels are the same between opposite edges of the panels and the widths are such that when corresponding panels for a scene are contiguous and coplanar, the edges of panels of adjacent display units nearly touch each other so there is no perceptible gap between panels.

4. The device according to claim 1 wherein said means for coupling said motor to said display units includes a driven member releasably engaged with a corresponding adapter element of each display unit, the driven member having a hub and the hub having a bore for journaling driven members for rotation on the respective tubes.

5. The device according to claim 4 wherein said adapter element has a hub and the driven member and adapter element are releasably engaged by having a lug extending axially from a selected one of the hubs on the driven member or on the adapter element and a notch in the other of the hub on the driven member or on the adapter element, respectively, for the lug to register in the notch to couple the driven member to the adapter element for rotating the display units.

6. The device according to claim 5 wherein the driven member is a gear rotatable on each of the tubes, said motor having a pinion meshed with one of said gears and all of said gears being intermeshed.

7. The device according to claim 1 including a strip of light reflective material fastened to a periphery of each of said tubes, said strip extending axially of the tube substantially coextensive with said elongated light source.

8. A device for displaying a plurality of scenes comprising:

a base member (57), a plurality of light transmissive tube retaining elements (58) fixedly mounted to said base member, said elements arranged on the base member (57) equally spaced apart from each other in straight row, a plurality of circular tubes (50) made out of a light transmitting material each having a lower end and an upper end, the lower ends being retained by said tube retaining elements (58), respectively, a plate member (59) spaced above the base member (57), said plate member having a straight row of holes (60) spaced apart in correspondence with the space between said retaining elements (58) for holding said tubes (50) parallel to each other, means for releasably supporting the plate member (59), a display unit (25) for rotating on each of the tubes (50), each said display unit including a pair of spaced apart adapter members (30, 40) and a plurality of light transparency panels (26, 27, 28) arranged in a prism configuration and having opposite open ends for coupling, respectively, to the adapter members, said adapter members having corresponding openings for encompassing each said display unit, respectively, on the tubes to provide for rotating the display units, each corresponding transparency panel of the display units constituting a portion of a different scene such that when panels representing a portion of a scene rotate to contiguous coplanar relationship said scene is composed, a tubular light source (51) disposed interiorly of each said tube (50), and an electric motor (70) and means (65, 72) for coupling said motor to said display units for driving said units rotationally in synchronism on said tubes.

9. The device according to claim 8 wherein:

each of the adapter members for a display unit has three sides arranged in a triangle and each display unit has three transparency panels arranged in a corresponding triangle to provide for said adapter members fitting snugly into the triangular arrangement of panels to form a display unit for being fitted onto one of said tubes as a unit.

10. The device according to claim 8 including:

controller means for energizing and deenergizing said motor to effect synchronous driving of said display units rotationally, and means for detecting the position of the panels for the same scene on adjacent display units becoming contiguous and coplanar, said controller means deenergizing said motor when said position is attained coincident with initiation of a time interval, said controller means responding to expiration of the time interval by reenergizing the motor to bring about presentation of a different scene.

11. The device according to claim 8 including a bushing in each of said adapter members, said bushings providing an opening for the display units to rotate on said tubes 50.

* * * * *